United States Patent [19]

Gomi et al.

[11] Patent Number: 4,477,334

[45] Date of Patent: Oct. 16, 1984

[54] THERMAL CRACKING OF HEAVY HYDROCARBON OILS

[75] Inventors: Shimpei Gomi, Tokyo; Tomomitsu Takeuchi, Yokohama; Itaru Matsuo, Matsudo; Masaki Fujii, Chiba; Toru Takatsuka, Yokohama; Ryuzo Watari, Yamato, all of Japan

[73] Assignees: Fuji Oil Co., Ltd.; Fuji Standard Research Inc.; Chiyoda Chemical Engineering & Construction Co., Ltd., all of Japan

[21] Appl. No.: 583,183

[22] Filed: Feb. 24, 1984

[30] Foreign Application Priority Data

Feb. 28, 1983 [JP] Japan ..... 58-32569

[51] Int. Cl.[3] ..... C10G 51/02; C10G 9/14

[52] U.S. Cl. ..... 208/75; 208/48 R; 208/50; 208/67; 208/72

[58] Field of Search ..... 208/48 R, 50, 72, 75, 208/67

[56] References Cited

U.S. PATENT DOCUMENTS

| | | | |
|---|---|---|---|
| 2,016,948 | 10/1935 | Trow | 208/75 |
| 2,063,505 | 12/1936 | Huff | 208/72 |
| 2,175,663 | 10/1939 | Herthel | 208/72 |
| 2,234,910 | 3/1941 | Barron | 208/75 |
| 2,247,740 | 7/1941 | Angell | 208/75 |
| 3,065,165 | 11/1962 | Amis et al. | 208/48 R |
| 3,928,170 | 12/1975 | Takahashi et al. | 208/40 |
| 4,214,979 | 7/1980 | Nakahishi et al. | 208/48 R |
| 4,264,432 | 4/1981 | Gartside | 208/48 R |

*Primary Examiner*—Delbert E. Gantz
*Assistant Examiner*—Lance Johnson
*Attorney, Agent, or Firm*—Kenway & Jenney

[57] ABSTRACT

A heavy hydrocarbon feed stock is, after being heat-treated in a first cracking zone, introduced into a second thermal cracking zone for obtaining a thermally cracked product and a pitch product. The second cracking zone has a plurality of cracking reactors which are connected in series, through which is successively passed the treated feed stock and to each of which is supplied a gaseous heat transfer medium to maintain the liquid phase therein at a temperature sufficient for effecting the thermal cracking and to strip the resulting distillable, cracked components from the liquid phase. The thermal cracking temperature in one reactor is so controlled as to become higher than that in its adjacent upstream-side reactor. The distillable, cracked components in respective reactors are removed overhead therefrom and separated into a heavy fraction and a light fraction, while the liquid phase in the downstream-end reactor is discharged therefrom for recovery as the pitch product. The light fraction is recovered as a light product oil, while the heavy fraction is fed to a third thermal cracking zone for obtaining a tar-containing product which is recycled to at least one of the reactors of the second thermal cracking zone.

15 Claims, 1 Drawing Figure

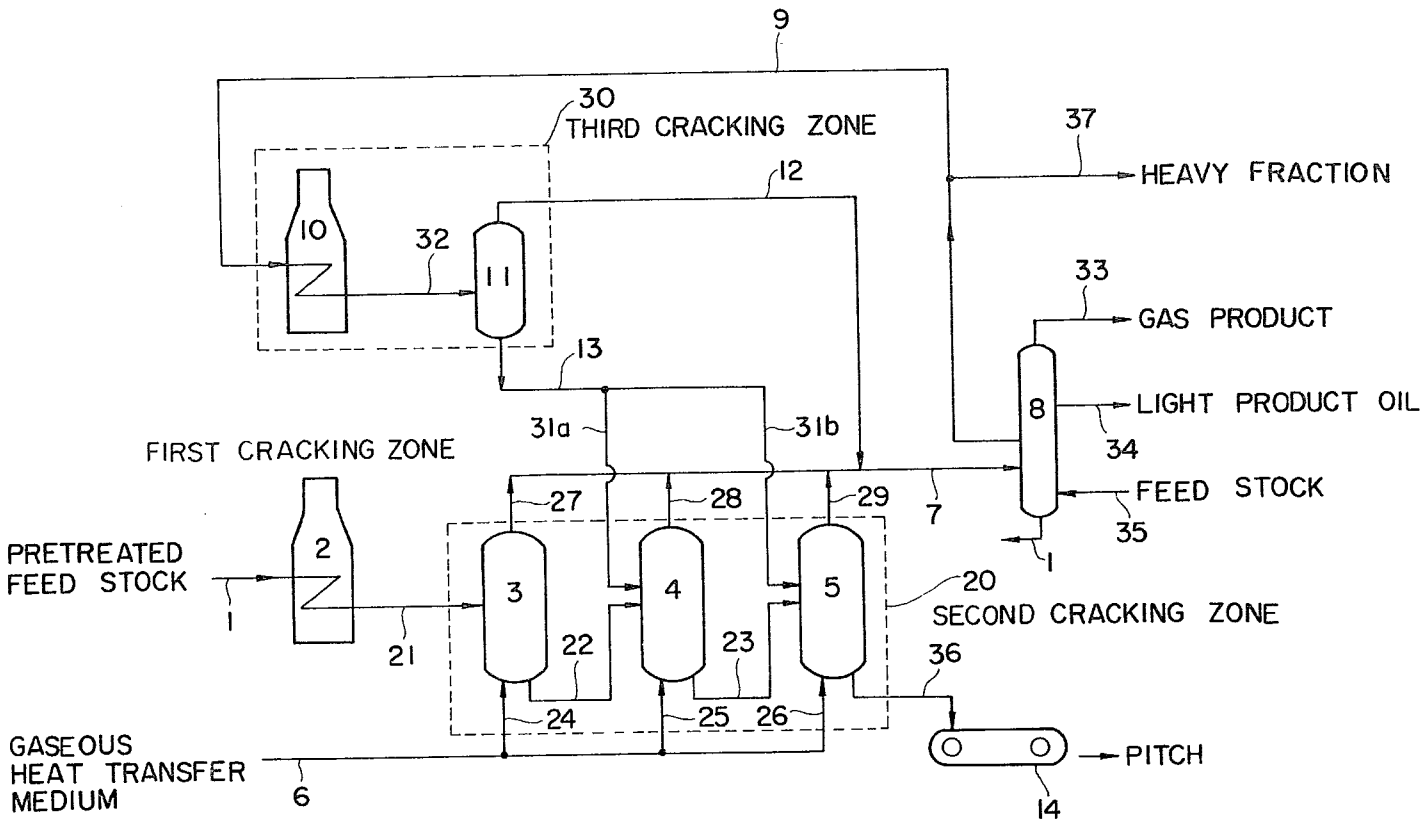
HEAVY FRACTION
GAS PRODUCT
LIGHT PRODUCT OIL
FEED STOCK
PITCH
SECOND CRACKING ZONE
THIRD CRACKING ZONE
FIRST CRACKING ZONE
PRETREATED FEED STOCK
GASEOUS HEAT TRANSFER MEDIUM
1
2
3
4
5
6
7
8
9
10
11
12
13
14
20
21
22
23
24
25
26
27
28
29
30
31a
31b
32
33
34
35
36
37

THERMAL CRACKING OF HEAVY HYDROCARBON OILS

BACKGROUND OF THE INVENTION

This invention relates generally to a process of thermally cracking a heavy hydrocarbon oil. More specifically, the present invention is directed to a process for the conversion of a heavy hydrocarbon oil into a light hydrocarbon oil and a pitch which is useful as a fuel by a continuous, multi-stage thermal cracking treatment. The present invention is also directed to an apparatus useful for carrying out such a process A variety of techniques have been hitherto proposed for treating heavy hydrocarbon oils to obtain utilizable products The thermal cracking is one such technique applicable to heavy petroleum fractions such as vacuum residues. U.S. Pat. No. 3,928,170 discloses a process, generally called Eureka process, in which a gaseous heat transfer medium is brought into direct contact with a heavy hydrocarbon oil for effecting the thermal cracking under relatively mild conditions and for stripping volatile cracked products to leave a pitch. The pitch product obtained by the Eureka process has a high content of resin components which are soluble in quinoline but insoluble in benzene, a low content of coke, a high content of aromatic components and a H/C atomic ratio of 1.0 or less and is useful as a binder for manufacturing coke and refractory materials. One problem encountered in the Eureka process is that the process is unavoidably operated in a semibatch mode because otherwise it is very difficult to prevent the occurrence of a coking during the thermal cracking of heavy hydrocarbon oils. Another problem is that the cracked hydrocarbon product has relatively a large amount of heavy hydrocarbon components and, therefore, is less valuable than light hydrocarbon oils.

Summary of the Invention

In accordance with one aspect of the present invention, a heavy hydrocarbon oil is fed to a first thermal cracking zone for thermally cracking same and for obtaining a first, cracked product. The first product is then passed successively through a series of thermal cracking reactors, which constitute a second thermal cracking zone, for further cracking the first product in each reactor. The thermal cracking in the second zone is effected by bringing a gaseous heat transfer medium into direct contact with the liquid phase, including the first product, in each of the reactors while supplying a coking-preventing agent, hereinafter described, to at least one of the reactors. The heat transfer medium serves to heat the first product to a temperature sufficient to induce the thermal cracking and to strip the resultant, distillable cracked components from the liquid phase in respective reactors. The cracking temperature in one reactor is so controlled as to become higher than that in its adjacent upstream-side reactor by, for example, controlling the feed rate of the heat transfer medium to each reactor. Thus, as the first product is passed from one reactor to the neighboring reactor, it is subjected to more severe thermal cracking conditions. The first product finally becomes a pitch which is withdrawn from the terminal end reactor for recovery. The distillable cracked components in each reactor are removed overhead therefrom and are collected as a second, cracked product which is rectified in a succeeding separating zone to obtain a light product oil and a heavy fraction. The heavy fraction is introduced into a third thermal cracking zone to obtain a tar-containing product which is recycled to at least one of the reactors of the second thermal cracking zone as the above-described coking-preventing agent. The whole of the above steps may be operated continuously.

In another aspect, the present invention provides an apparatus useful for carrying out the above process.

It is, therefore, an object of the present invention to provide a process of thermally cracking heavy hydrocarbon oils, by which the problem encountered in the conventional process is overcome.

It is a more specific object of the present invention to provide a continuous process by which heavy hydrocarbon oils can be converted, with a high yield and without encountering with a coking problem, into light hydrocarbon oils with the simultaneous production of a pitch suitable as a fuel.

It is a further object of the present invention to provide an apparatus which is suited to conduct the above process.

BRIEF DESCRIPTION OF THE DRAWING

Other objects, features and advantages of the present invention will become apparent from the detailed description of the preferred embodiments of the invention which follows, when considered in light of the accompanying drawing, in which:

the sole FIGURE is a flow diagram schematically showing one embodiment of the thermal cracking system for carrying out the process according to the present invention.

DETAILED DESCRIPTION OF THE PREFERRED EMBODIMENTS OF THE INVENTION

Referring now to the FIGURE, a heavy hydrocarbon feed stock is, preferably after being preheated, passed via line 35 to the bottom of a distillation tower 8, described hereinafter, where the volatile components contained in the feed stock are removed. Examples of the hydrocarbon feed stock include heavy petroleum fractions such as atmospheric residues, vacuum residues and reduced crude oils and other heavy hydrocarbon products such as those resulting from the cracking of crude petroleum oil, asphalt products from solvent deasphaltene processes, native natural asphalt and heavy liquified coal oils. The feed stock in the bottom of the tower 8 is fed via line 1 to a first thermal cracking zone 2 where the feed stock is subjected to thermal cracking conditions. The feed stock may be directly introduced into the first cracking zone 2 without being pretreated in the distillation tower 8. Preferably, the first cracking zone 2 is a cracking furnace having a tubular reactor through which the feed stock is streamed to undergo the thermal cracking. The thermal cracking in the first cracking zone 2 is generally performed at a temperature between 450° and 500° C. and a pressure of from normal pressure to 20 $Kg/cm_2G$ for a period of time between 0.5 and 5 min while substantially preventing the occurrence of coking, i.e. the formation of toluene insolubles. When a vacuum residue is used as the feed stock, the thermal cracking in the first cracking zone 2 is preferably continued until the yield of the cracked product reaches about 30 to 40 weight % based on the weight of the feed stock supplied.

The product (or first, thermally cracked product) from the first cracking zone 2 is then introduced via line 21 into a second thermal cracking zone 20 for the further thermal cracking treatment thereof conducted, preferably, at temperatures of between 400° and 440° C. The second cracking zone 20 includes a plurality, preferably between 2 and 4, of cracking reactors 3, 4 and 5 connected in series by lines 22 and 23. To the cracking reactors 3, 4 and 5 is supplied a gaseous heat transfer medium through lines 24, 25 and 26, respectively, which are branched from a line 6 which is connected to a source of the heat transfer medium. The gaseous heat transfer medium is preferably a substantially oxygen-free, non-oxidative gas such as steam, a hydrocarbon gas or a perfect combustion waste gas and generally has a high temperature, preferably between 500° and 800° C. The heat transfer medium serves to a maintain the liquid phase, containing the first, thermally cracked product, within each reactor at a temperature sufficient for effecting the thermal cracking thereof, to strip the resultant distillable, cracked components from the liquid phase, to stirr the liquid phase and to prevent the occurrence of coking in each reactor. The distillable cracked components in the reactors 3, 4 and 5 are removed therefrom through lines 27, 28 and 29, respectively, and fed, as a second, thermally cracked product, to the distillation tower 8 through a line 7. The thermal cracking temperature in one reactor is so controlled as to become higher, preferably by at least 5° C., more preferably between 5° and 10° C., than that in the adjacent reactor located downstream thereof. The control of the cracking temperature in each of the reactors 3, 4 and 5 may be done in various manners such as by controlling the feed rates of the gaseous heat transfer medium to the reactors 3, 4 and 5 and by controlling the temperature of a tar-containing product (hereinafter described) supplied to one or more of the reactors 3, 4 and 5. The thermal cracking in each of the reactors 3, 4 and 5 is suitably performed at a pressure of from normal pressure to 5 $Kg/cm^2G$ for between 0.1 and 8 hours, more preferably between 0.2 and 2 hours.

The thermal cracking in the second cracking zone 20 will be described in more detail below with reference to the embodiment as shown in the FIGURE in which the zone 20 has three reactors 3, 4 and 5. The first product from the first cracking zone 2 is first introduced into the first reactor 3, located at the upstream-end of the zone 20, where it is mixed with and heated, preferably to a temperature of between 400° and 420° C., by the gaseous heat transfer medium supplied through the line 24 and undergoes thermal cracking. The distillable cracked components are stripped with the heat transfer medium and are discharged overhead from the reactor 3. A portion of the liquid phase in the reactor 3 is continuously discharged from the bottom of the reactor 3 to maintain the volume of the liquid phase within the reactor 3 within a predetermined level. This portion is streamed into the adjacent reactor 4 positioned downstream of the reactor 3, where it is subjected to thermal cracking at a higher temperature than that in its upstream-side reactor 3, preferably at a temperature of between 410° and 430° C., upon contact with the heat transfer medium supplied through the line 25. The distillable cracked components are stripped from the liquid phase in the reactor 4 and are removed overhead from the reactor 4 through the line 28 while a portion of the remaining liquid phase in the reactor 4 is continuously passed to its adjacent downstream-side reactor 5 while maintaining the volume of the reaction liquid within the reactor 4 within a predetermined range. In the reactor 5, which is located at the downstream-end of the second zone 20, the liquid from the reactor 4 is further thermally cracked at a higher temperature than that in the reactor 4, preferably at a temperature of between 420° and 440° C., by contact with the gaseous heat transfer medium supplied from the bottom of the reactor 5 through the line 26. The resulting distillable components are discharged from the top through the line 29 and a portion of the remaining liquid phase in the reactor 5 is continuously discharged from the bottom through a line 36 to maintain the volume of the liquid within the reactor 5 within a predetermined range and this portion is passed to a flaker 14 where it is solidified for recovery as a pitch product.

Thus, the first product from the first cracking zone 2 is successively passed through a series of the cracking reactors to undergo in each reactor thermal cracking whose temperature is gradually increased as the first product is passed from one reactor to its downstream-side reactor. During the passage of the first product through respective reactors, the distillable components formed by thermal cracking are continuously removed therefrom and the first product gradually becomes a pitch due to the polycondensation and aromatization reactions inherent to the thermal cracking. The thermal cracking in the second cracking zone 20 proceeds very effectively since heavy hydrocarbon components which are formed during the thermal cracking in one reactor and which would require a long dwell time may be cracked in the subsequent reactors arranged for effecting more severe cracking. The pitch obtained from the second thermal cracking zone 20 has at least 25 weight %, generally between 25 and 40 weight % of volatile matters and is suitably used as fuels. Further, the pitch has a high softening point, generaly 140° C. or higher. It is possible in accordance with the process of this invention to obtain a pitch having a softening point of about 300° C.

As each of the reactors forming the second cracking zone 20, it is preferable to use a continuous stirred tank reactor which is known per se. The reactor is generally equipped with a stirr disposed therewithin. In order to keep the interior surfaces of the reactor clean, a wetted-wall system or scraper means may be suitably employed.

The distilled components, including cracked gases and cracked oils and being discharged from the reactors of the second cracking zone 20 together with the gaseous heat transfer medium, are fed through the line 7 to the distillation tower 8 to separate same into a gas fraction, a light fraction (for example, a fraction having a boiling point of not higher than 370° C.) and a heavy fraction (for example, a fraction having a boiling point of higher than 370° C.). The gaseous fraction is discharged from the top through a line 33 and the light fraction is removed through a line 34 for recovery as a light product oil. The heavy fraction is discharged from the distillation tower 8 through a line 9 for the introduction into a third thermal cracking zone 30 where it is thermally cracked to obtain a tar-containing product with a high content of aromatic components. The tar-containing product is recycled to the second cracking zone 20. Since the heavy fraction supplied to the third cracking zone 30 has been once subjected to thermal hysteresis and has a slow cracking rate, the third cracking zone is operated at a higher temperature than that in the second cracking zone 20. If necessary, a portion of the heavy fraction from the tower 8 may be discharged through a line 37.

Any known reactors can be employed for the third cracking zone 30, such as a cracking furnace and a continuous stirred tank reactor. Preferably, a combination of a cracking furnace and a soaker is employed, as illustrated in the FIGURE, for effectively cracking the heavy fraction. In this case, the heavy fraction from the tower 8 is first introduced into the cracking furnace 10 where it is thermally cracked at a temperature of between 450 and 520° C. and a pressure of between 0.3 and 150 $Kg/cm^2G$ for a period of between 0.5 and 20 min. The resulting product as heated is then fed via line 32 to the soaker 11 where it is aged or soaked with stirring at a temperature of between 400° and 460° C. and a pressure of between 0.1 and 50 $Kg/cm^2G$ and for a period of between 0.1 and 8 hours (in terms of an average residence time) for further thermal cracking thereof and for formation of a tar. In the soaker 11, the distillable cracked product generally having a boiling point of 370° C. or below is allowed to be discharged overhead therefrom for recycling to the distillation tower 8 and the remaining liquid phase containing a tar is continuously discharged from the bottom thereof for recycling to the second cracking zone 20 through a line 13. In this combination, the majority of the thermal cracking is generally effected in the soaker 11. If desired, superheated steam may be passed through the liquid phase in the soaker for stirring same and for maintaining same at a suitable temperature. When the cracking furnace 10 is used by itself as the reactor of the third cracking zone 30, the resultant tar-containing product may be recycled to the second cracking zone 20 either as such or after the removal of its light components in a gas-liquid separator (not shown). The tar-containing product from the third cracking zone 30, preferably having a boiling point of 370° C. or more, is recycled to at least one reactor (two reactors 4 and 5 in the illustrated case) of the second cracking zone 20 through lines 13, 31*a* and 31*b*.

Since, in the second cracking zone 20, both the conversion of heavy hydrocarbons into light hydrocarbons by cracking and the formation of a pitch by polycondensation and aromatization occur, coking troubles are apt to occur in the zone 20. Especially, the reactors located in the downstream-side of the zone 20 are subjected to conditions in which coking is liable to occur because the thermal cracking in such reactors is effected at high temperatures. In order to prevent coking to take place, the tar-containing product obtained in the third cracking zone 30 is supplied to the second cracking zone 20. That is, the tar having a high content of aromatic components serves to function as a solvent so that the aggromeration and growth of coke precursors are effectively prevented. As a consequence, the occurrence of coking is prevented and the thermal cracking in the second cracking zone 20 can be continuously and smoothly conducted. It is preferred that the tar-containing product be fed to the downstream-side reactor or reactors operated at a higher temperature or temperatures. The tar-containing product from the third cracking zone 30 may be introduced into respective reactors after being mixed with the liquid feed supplied thereto through lines 22 and 23 or separately. In the latter case, the tar-containing product may be fed to respective reactors in such a manner as to wet the interior surface thereof. The amount of the tar-containing product to be supplied to each reactor varies according to the kind of the feed stock and the conditions of the thermal cracking effected therein, but, generally, an amount of the tar-containing product in the range of between 5 and 50 weight % based on the amount of liquid phase in each reactor is suited for the avoidance of the coking troubles. If desired, aromatic-rich cracked oils obtained in other processes than the present process, such as a slurry oil from a fluidized bed catalytic cracking process, may be fed together with the tar-containing product to the second cracking zone 20.

The entire steps described above in the process of the present invention may be advantageously operated in a fully continuous system. According to the present invention, heavy hydrocarbon oils may be efficiently converted into light hydrocarbon oils with a high yield and with the additional production of a pitch with a high softening point, say between 200° and 300° C., while effectively preventing the occurrence of coking. It is known to recycle to a thermal cracking step a heavy fraction separated from a thermally cracked product produced in the thermal cracking step of a feed stock. In this case, however, since the cracking velocity of the heavy fraction is much slower than that of the feed stock, the conversion of the heavy fraction into light product oil cannot be effected to a satisfactory degree. Therefore, it becomes necessary to increase the amount of the heavy fraction recycled to the cracking step in order to obtain light product oil with a satisfactory yield. But this is disadvantageous in practice. In contrast, in the process of the present invention, the thermal cracking of such a heavy fraction is conducted in a zone separate from the cracking zone of the feed stock and light product oil can be obtained efficiently. Further, the resultant tar produced during the thermal cracking of the heavy fraction is recycled to the cracking zone for the effective utilization for the prevention of coking therein.

The following example will further illustrate the present invention.

Example 1

A vacuum residue from a mixed crude oil composed of a Middle East crude and a Venezuelan crude was used as a feed stock for the thermal cracking treatment according to the present invention. The feedstock had a specific gravity (15/4° C.) of 1.0274 and a Conradson carbon residue of 22.4 weight %. The feed stock was continuously passed at a feed rate of 510 g/hr to a cracking furnace (first cracking zone) where it was thermally cracked at 490° C. for a short time. The resulting first product was fed successively through first, second and third reactors (second cracking zone), each of which had an inside volume of one liter and which were connected in series, for the further thermal cracking treatment thereof in each reactor. High temperature steam was supplied to each reactor to effect the thermal cracking at temperatures of 418° C., 426° C. and 431° C. in the first through third reactors, respectively. To the second and third reactors was fed a tar-containing product (hereinafter described) having a temperature of 440° C. at feed rates of 45 g/hr and 40 g/hr, respectively. The overhead products from the first through third reactors were collected as a second cracked product while the liquid in the third reactor was discharged therefrom at a rate of 165.5 g/hr as a pitch product. The second cracked product was separated into a gas fraction ($C_4$ or below), a light fraction ($C^5$ to 370° C.) and a heavy fraction (370° to 550° C.).

The heavy fraction was subjected to a further cracking temperature in a combination of a cracking furnace and a soaker (third cracking zone). Thus, the heavy fraction was heated to 490° C. in the cracking furnace and the resulting product was passed into the soaker having an inside volume of one liter at a feed rate of 500 g/hr for the cracking treatment thereof at a temperature of 440° C. The overhead product from the soaker was continuously recovered and the residual oil was continuously discharged from the bottom of the soaker for recovery as the above-mentioned tar-containing product, a portion of which was used in the second and third reactors of the second cracking zone as described previously. The properties of the heavy fraction, conditions of the cracking treatment of the heavy fraction, yields of the cracking products in the soaker and the properties of the tar-containing product (residual oil) are summarized in Table 1.

TABLE 1

| | |
|---|---|
| Properties of heavy fraction | |
| Specific gravity (15/4° C.) | 0.945 |
| Boiling point (°C.) | 370–550 |
| Aromatics content (wt %)* | 29.2 |
| Cracking conditions | |
| Cracking furnace | |
| Feed rate (g/hr) | 500 |
| Temperature at the outlet (°C.) | 490 |
| Soaker | |
| Cracking temperature (°C.) | 440 |
| Pressure (Kg/cm$^2$G) | 3.1 |
| Average dwell time (min) | 49 |
| Yield of cracking products (wt %) | |
| Overhead | |
| Gas ($C_4$ or below) | 3.2 |
| Lightt oil ($C_5$ to 370° C.) | 30.9 |
| Heavy oil (370 to 540° C.) | 14.4 |
| Residual oil (370° C.+) | 51.4 |
| Properties of residual oil | |
| Specific gravity (15/4° C.) | 1.044 |
| Boiling point (°C.) | 370+ |
| Aromatics content (wt %)* | 61.0 |

*Aromatics content: Measured by $C^{13}$NMR. Ratio of the number of aromatic carbon atoms to the total number of carbon atoms.

The above described thermal cracking of the feed stock was continued for 12 hours. No coking troubles were encountered during the thermal cracking and the inside wall of each of the reactors of the second cracking zone was found to be clean after the termination of the cracking operation. The cracking conditions in the first and second cracking zones, yields of the second cracked products and the pitch product from the second cracking zone and the properties of the pitch are summarized in Table 2. The softening point was determined by means of a Koka-type flow tester and was a temperature at which the sample commenced to flow through a nozzle having a diameter of 1 mm when heated at a rate of 6° C./min under a pressure of 10 Kg/cm$^2$.

TABLE 2

| | Example | Comparative Example |
|---|---|---|
| Cracking conditions | | |
| Cracking furnace | | |
| Feed rate (g/hr) | 510 | 510 |
| Temperature at the outlet (°C.) | 490 | 490 |
| First reactor | | |
| Cracking temperature (°C.) | 418 | 422 |

TABLE 2-continued

| | Example | Comparative Example |
|---|---|---|
| Average dwell time (min) | 62 | 40 |
| Second reactor | | |
| Cracking temperature (°C.) | 426 | 420 |
| Average dwell time (min) | 64 | 49 |
| Feed rate of tar-containing product (g/hr) | 45 | — |
| Third reactor | | |
| Cracking temperature (°C.) | 431 | 420 |
| Average dwell time (min) | 65 | 55 |
| Feed rate of tar-containing product (g/hr) | 40 | — |
| Yield of cracking products in the second cracking zone (wt %) | | |
| Gas fraction ($C_4$ or below) | 3.5 | 3.3 |
| Light fraction ($C_5$ to 370° C.) | 26.9 | 26.5 |
| Heavy fraction (370 to 550° C.) | 41.7 | 36.6 |
| Pitch | 27.8 | 33.4 |
| Properties of pitch | | |
| Softening point | 270 | 186 |
| Volatile matter content | 28.4 | 38.1 |
| Heptane insoluble content | 92.2 | 82.4 |
| Tolune insoluble content | 78.2 | 63.0 |
| Quinoline insoluble content | 48.7 | 26.1 |

Comparative Example

The feed stock as used in Example was thermally cracked continuously for 10 hours in the first and second cracking zones in the same manner as described in Example except that the tar-containing product was not added to the second and third cracking reactors and the cracking temperatures in the first through third cracking reactors were maintained at about 420° C. There was obtained a pitch product at a rate of 170.5 g/hr. The conditions of the thermal cracking, yields of cracking products and the properties of the pitch are also shown in Table 2. The inspection of the interior of the reactors after the termination of the cracking operation revealed a deposition of coke. Thermal cracking tests with the use of the above system were carried out under various different conditions with a view to obtaining a pitch with a high softening point. However it was found to be difficult to obtain a high softening point pitch without encountering with coking problems.

As will be seen from the results in Table 2, the yield of the pitch in the case of the process of the present invention is lower than that of the known process notwithstanding the addition of a large amount of tar-containing product having a boiling point of 370° C. or more. This means that the addition of the tar-containing product makes it possible to conduct the thermal cracking in the second cracking zone under drastic conditions, while preventing the occurrence of coking, with the results that the yield of the pitch is reduced and the softening point of the pitch becomes high. Table 3 shows the overall yield of the respective products from the process in the above Example and Comparative Example. It is apparent from the results shown in Table 3 that the process of the present invention can produce a light product oil with a high yield. It is confirmed that the pitch obtained by the process of the present invention is useful as fuels. Further, the yield of the heavy oil can be reduced to almost zero by recycling the entire amount of the heavy fraction derived from the second cracked product to the third cracking zone.

TABLE 3

| Cracking Product | Example | Comparative Example |
|---|---|---|
| Gas ($C_4$ or below) | 5.1 wt % | 3.3 wt % |
| Light oil ($C_5$ to 370° C.) | 41.4 | 26.5 |
| Heavy oil (370 to 550° C.) | 20.9 | 36.6 |
| Pitch | 32.4 | 33.4 |

We claim:

1. A process for thermally cracking a heavy hydrocarbon oil, comprising the steps of:

(a) feeding the heavy hydrocarbon oil into a first thermal cracking zone for thermally cracking the heavy hydrocarbon oil and for obtaining a first, thermally cracked product;

(b) introducing said first product into a second thermal cracking zone for thermally cracking said first product and for obtaining a second, thermally cracked product and a pitch product, said second cracking zone having a plurality of cracking reactors which are connected in series, through which is successively passed said first product and to each of which is supplied a gaseous heat transfer medium to maintain the liquid phase therein, including said first product, at a temperature sufficient for effecting the thermal cracking and to strip the resulting distillable, cracked components from the liquid phase, the thermal cracking temperature in one reactor being so controlled as to become higher than that in its adjacent upstream-side reactor, the distillable, cracked components in respective reactors being removed overhead therefrom as said second product, the liquid phase in the downstream-end reactor being discharged therefrom for recovery as said pitch product;

(c) separating said second product into a heavy fraction and a light fraction;

(d) recovering said light fraction as a light product oil;

(e) introducing said heavy fraction into a third thermal cracking zone for thermally cracking same and for obtaining a tar-containing product; and (f) recycling said tar-containing product to at least one of said reactors of said second thermal cracking zone.

2. A process as claimed in claim 1, wherein step (a) is performed at a temperature of between 450° and 500° C. and a pressure of between normal pressure and 20 $Kg/cm_2G$ for a period of between 0.5 and 5 min while substantially preventing the formation of toluene insolubles.

3. A process as claimed in claim 1, wherein the number of the cracking reactors of said second thermal cracking zone is between 2 and 4.

4. A process as claimed in claim 1, wherein the thermal cracking of step (b) is performed at temperatures of between 400° and 440° C.

5. A process as claimed in claim 1, wherein the thermal cracking in one cracking reactor is performed at a temperature at least 5° C. higher than that in its adjacent upstream-side reactor.

6. A process as claimed in claim 1, wherein the second thermal cracking zone includes first, second and third cracking reactors and wherein the thermal cracking in the first cracking reactor is performed at a temperature of between 400° and 420° C., that in the second reactor is between 410° and 430° C. and that in the third reactor is between 420° and 440° C.

7. A process as claimed in claim 1, wherein said gaseous heat transfer medium is superheated steam.

8. A process as claimed in claim 1, wherein step (b) is performed so that the pitch product has a volatile matter content of between 25 and 40 weight % and a softening point of between 200° and 300° C.

9. A process as claimed in claim 1, wherein said heavy fraction has a boiling point of 370° C. or more.

10. A process as claimed in claim 1, wherein step (e) includes introducing said heavy fraction into a cracking furnace for thermally treating same, and feeding the thus treated heavy fraction to a soaker for soaking same and for forming a tar, the tar-containing liquid in the soaker being discharged from the bottom of the soaker as said tar-containing product.

11. A process as claimed in claim 10, wherein said thermal treatment in the cracking furnace is performed at a temperature of between 450° and 520° C. and a pressure of between 0.3 and 150 $Kg/cm^2G$ and for a period of between 0.5 and 20 min and said soaking treatment in said soaker is performed at a temperature of between 400° and 460° C. and a pressure of between 0.1 and 50 $Kg/cm^2G$ and for a period of between 0.1 and 8 hours.

12. A process as claimed in claim 10, wherein the tar-containing liquid has a boiling point of 370° C. or more.

13. A process as claimed in claim 10, further comprising removing volatile components in the soaker overhead from the soaker and recycling the overhead components to step (c).

14. A process as claimed in claim 1, wherein said tar-containing product is fed to one or more reactors located downstream of the upstream-end reactor.

15. A process as claimed in claim 1, wherein the amount of said tar-containing product supplied to each reactor is between 5 and 50 weight % of the liquid phase in each reactor.

* * * * *